US008011988B2

(12) United States Patent
Miyabayashi

(10) Patent No.: US 8,011,988 B2
(45) Date of Patent: Sep. 6, 2011

(54) METHOD FOR ASSEMBLING INDIRECTLY-HEATED CATHODE ASSEMBLY

(75) Inventor: Kenji Miyabayashi, Kyoto (JP)

(73) Assignee: Nissin Ion Equipment Co., Ltd., Kyoto (JP)

( * ) Notice: Subject to any disclaimer, the term of this patent is extended or adjusted under 35 U.S.C. 154(b) by 315 days.

(21) Appl. No.: 12/485,621

(22) Filed: Jun. 16, 2009

(65) Prior Publication Data

US 2010/0015878 A1 Jan. 21, 2010

(30) Foreign Application Priority Data

Jul. 18, 2008 (JP) ..... 2008-187093

(51) Int. Cl.
*H01J 9/02* (2006.01)

(52) U.S. Cl. ..... 445/35; 445/49

(58) Field of Classification Search ..... 445/35–36, 445/49–51, 3; 313/359.1, 230, 238, 270, 313/310, 337; 140/71.5–71.6
See application file for complete search history.

(56) References Cited

U.S. PATENT DOCUMENTS 7,887,034 B2 * 2/2011 Krause et al. ..... 269/6
2008/0072413 A1 3/2008 Krause et al.

* cited by examiner

*Primary Examiner* — Anne Hines
(74) *Attorney, Agent, or Firm* — Osha • Liang LLP

(57) ABSTRACT

A width of a groove of a cathode holder and a thickness of a cathode conductor are determined so that a dimension which is obtained by subtracting the thickness from the width is equal to a gap length which has a predetermined length, and which is between a filament and a cathode. Then, the cathode holder is rearward pushed to cause a front end face of the groove 26 to butt against the cathode conductor, and the cathode conductor and filament conductors are coupled and fixed to each other via an electrically insulating material. And then, the filament is forward moved to butt against the cathode, and the filament is fixed to the filament conductors. After that, the cathode holder is forward pulled to cause a projection to butt against the cathode conductor, and the cathode holder is fixed to the cathode conductor.

2 Claims, 8 Drawing Sheets

METHOD FOR ASSEMBLING INDIRECTLY-HEATED CATHODE ASSEMBLY

This application claims priority from Japanese Patent Application No. 2008-187093, filed on Jul. 18, 2008, the entire contents of which are hereby incorporated by reference.

FIELD OF THE INVENTION

The present invention relates to a method for assembling an indirectly-heated cathode assembly which is to be used in, for example, an indirectly-heated ion source or a plasma generating apparatus.

DESCRIPTION OF RELATED ART

In assembling of an indirectly-heated cathode assembly having a structure in which a cathode for emitting thermal electrons is heated by a filament, it is important to adjust a gap length between the filament and the cathode to a predetermined length, because the gap length largely affects the electron emission characteristics of the cathode.

As a related art of a method for adjusting such a gap length, U.S. Patent Application Publication No. US2008/0072413A1 (Patent Reference 1) discloses a gap length adjusting method in which a small opening having a predetermined dimension is disposed in a tip end of a positioning clamp supporting a cathode, a gap adjusting jig (positioning tool) is inserted into the opening, and a distance by which a filament is to be moved is determined by using the gap adjusting jig, thereby adjusting the gap length to a predetermined length.

The related art disclosed in Patent Reference 1 has problems such as: (a) the special gap adjusting jig is required; (b) also a working accuracy of the gap adjusting jig affects the gap length, and hence, in addition to a working accuracies of the positioning clamp and the like, also the working accuracy of the gap adjusting jig is required to be high; (c) it is difficult to accurately position the gap adjusting jig into the small opening of the tip end of the positioning clamp, and hence a workability is poor; and (d) also when the gap adjusting jig is not used in the adjustment, the jig must be managed, and the management is cumbersome.

SUMMARY OF INVENTION

Illustrative aspects of the present invention provide a method for assembling an indirectly-heated cathode assembly where, even when a gap adjusting jig is not used, a gap length between a filament and a cathode can be adjusted to a predetermined length.

According to a first illustrative aspect of the invention, a method for assembling an indirectly-heated cathode assembly including: a tubular cathode holder which, assuming that a side from which thermal electrons are emitted is a front side, supports a cathode that emits thermal electrons, at the front side; a cathode conductor which supports the cathode holder; a filament which heats the cathode; and two filament conductors which support the filament, and which are juxtaposed with each other, is provided with:

disposing a groove and a projection in an outer circumference of the cathode holder, the projection projecting from a rear end of the groove in a direction which perpendicularly intersects an axis of the cathode holder;

disposing an opening fitting a portion of the groove in the cathode conductor, a peripheral portion of the opening being engaged with the projection, determining, in the groove, a width (W) between the projection and a front end face of the groove and a thickness (T) of the cathode conductor in the periphery of the opening so that a dimension (W−T) which is obtained by subtracting the thickness (T) from the width (W) is substantially equal to a predetermined gap length (G) which is between the filament and the cathode, and which extends in a direction along an axis of the cathode holder, fitting the portion of the groove into the opening of the cathode conductor to attach the cathode holder to the cathode conductor, rearward pushing the cathode holder to cause the front end face of the groove to butt against the cathode conductor, coupling and fixing the cathode conductor and at least one of the two filament conductors to each other via an electrically insulating material, forward moving the filament to butt against the cathode, fixing the filament to the two filament conductors, forward pulling the cathode holder to cause the projection to butt against the cathode conductor, and fixing the cathode holder to the cathode conductor.

Other aspects and advantages of the invention will be apparent from the following description, the drawings and the claims.

DETAILED DESCRIPTION OF EXEMPLARY EMBODIMENTS

Figure 1:
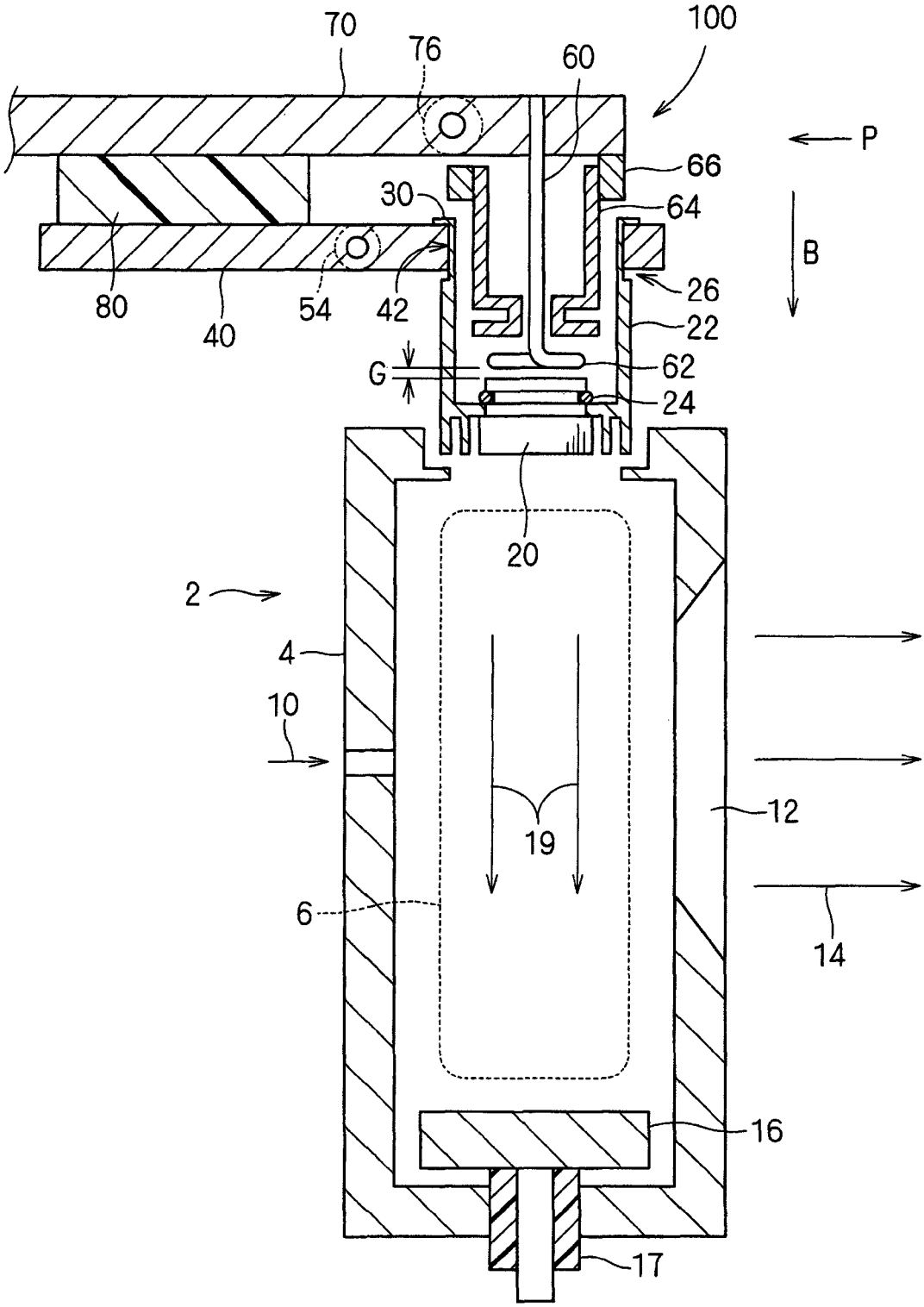
FIG. 1 is a schematic section view showing an example of an ion source including an indirectly-heated cathode assembly.

FIG. 1 is a schematic section view showing an example of an ion source including an indirectly-heated cathode assembly. An ion source 2 is an indirectly-heated ion source, and configured so that thermal electrons are emitted from an indirectly-heated cathode assembly 100 (more specifically, a cathode 20) into a plasma generating chamber 4 functioning also as an anode, a discharge is produced between the cathode 20 and the plasma generating chamber 4, a gas (including the case of vapor) 10 introduced into the plasma generating chamber 4 is ionized to produce a plasma 6, and an ion beam 14 is extracted from the plasma 6 through an ion extraction port 12. For example, the indirectly-heated cathode assembly 100 is placed so that the cathode 20 is downward directed in a vertical direction B with respect to the plasma generating chamber 4.

The ion source 2 has a reflecting electrode 16 which reflects electrons, in the plasma generating chamber 4 on the side opposite to the cathode 20. A reference numeral 17 denotes an electrically insulating material. A magnetic field 19 which extends in a direction along an axis connecting the cathode 20 with the reflecting electrode 16 is applied in the plasma generating chamber 4, by a magnet which is not shown. A direction of the magnetic field 19 may be opposite to the illustrated one.

The indirectly-heated cathode assembly 100 includes: a tubular cathode holder 22 which, assuming that a side from which thermal electrons are emitted (the lower side in FIGS. 1 and 5 to 7) is the front side, supports the cathode 20 that emits thermal electrons, at the front side; a cathode conductor 40 which supports the cathode holder 22; a filament 60 which heats the cathode 20; and two (see FIG. 3) filament conductors 70 which support the filament 60. In the example, the cathode holder 22 has a cylindrical shape, and the cathode 20 has a generally columnar shape as a whole.

Figure 4:
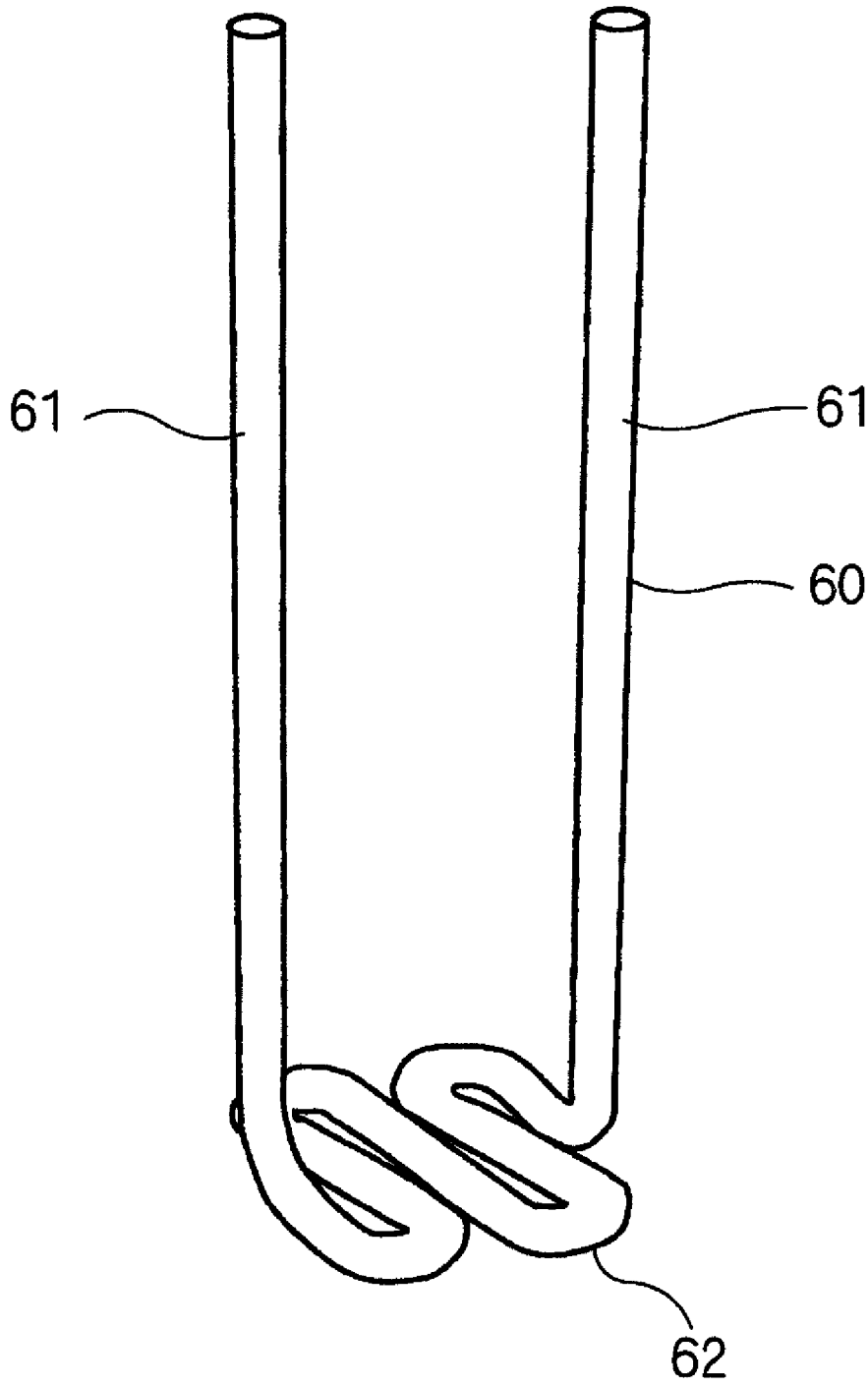
FIG. 4 is a perspective view showing an example of a filament.

In the example, as shown in FIG. 4, the filament 60 has an overall shape which is bent back to a generally U-like shape, and has two leg portions 61 and a bent portion 62 which connects between the leg portions 61. The bent portion 62 has a shape which is bent along a rear face of the cathode 20.

In the example, the cathode 20 is attached to an interior of the tip end portion of the cathode holder 22 by using an annular lock wire 24. However, the structure for supporting the cathode 20 is not restricted to the example.

Figure 5:
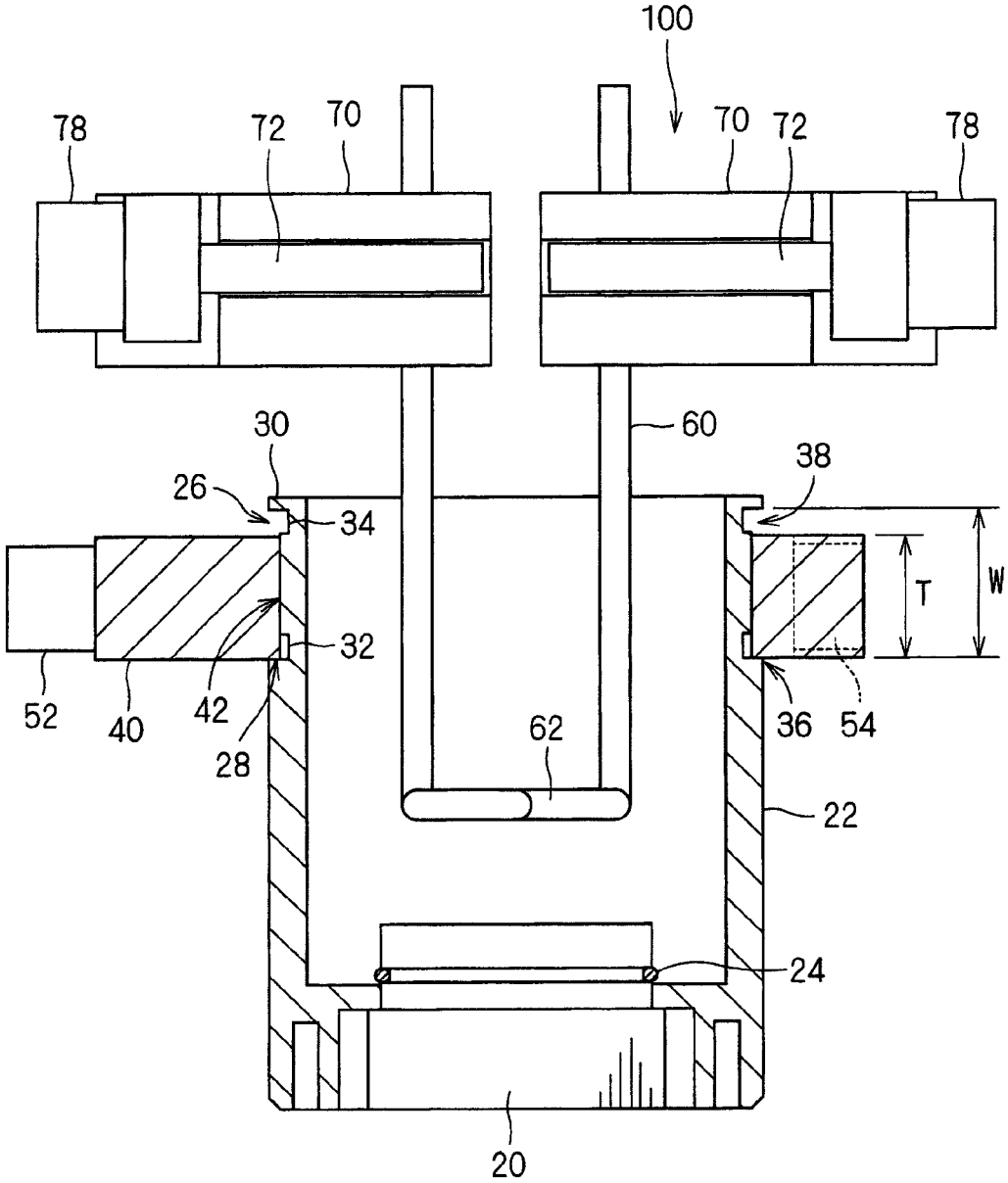
FIG. 5 is a view illustrating a method for assembling an indirectly-heated cathode assembly according to the invention.
Figure 6:
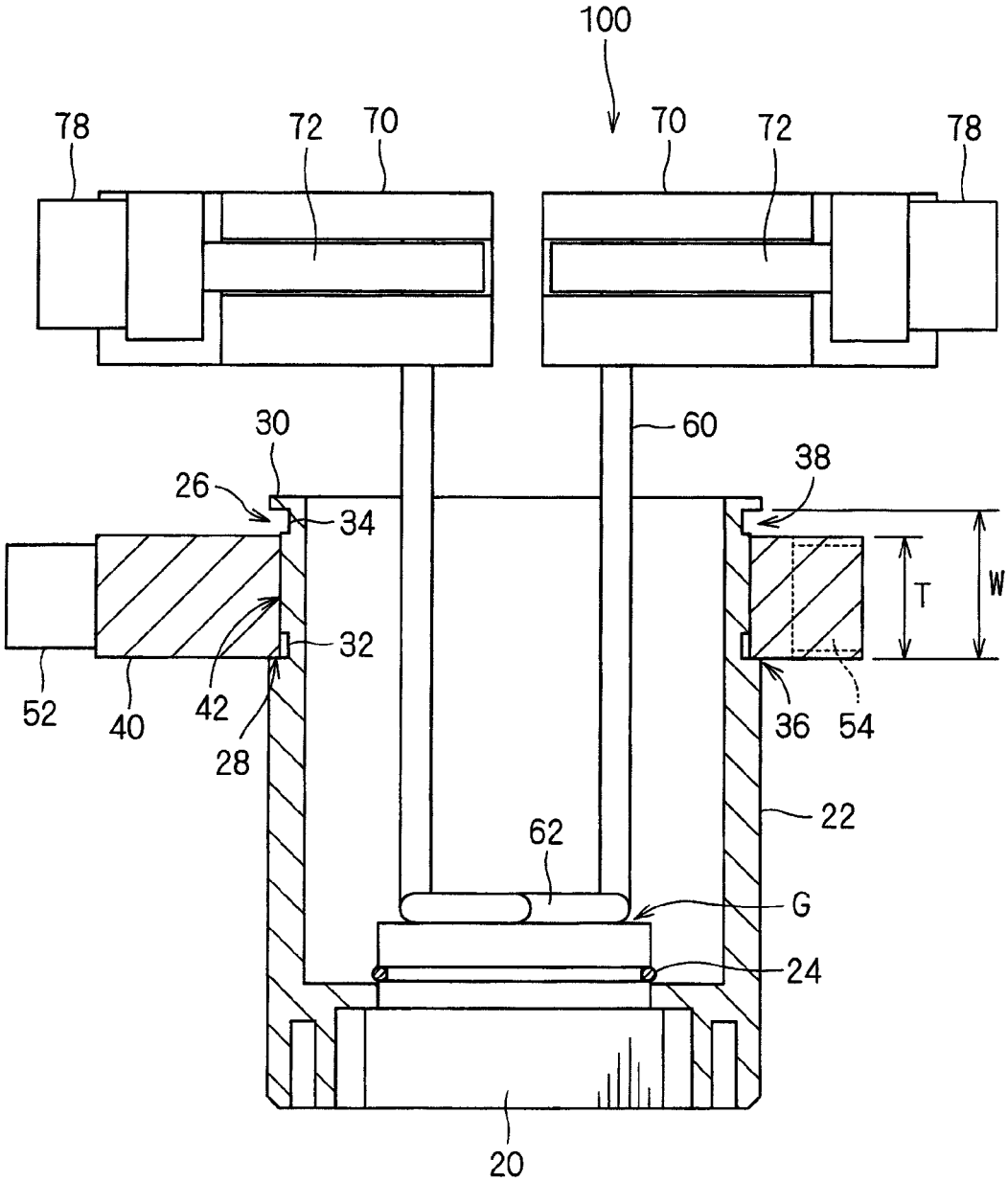
FIG. 6 is a view illustrating the method for assembling an indirectly-heated cathode assembly according to the invention.
Figure 7:
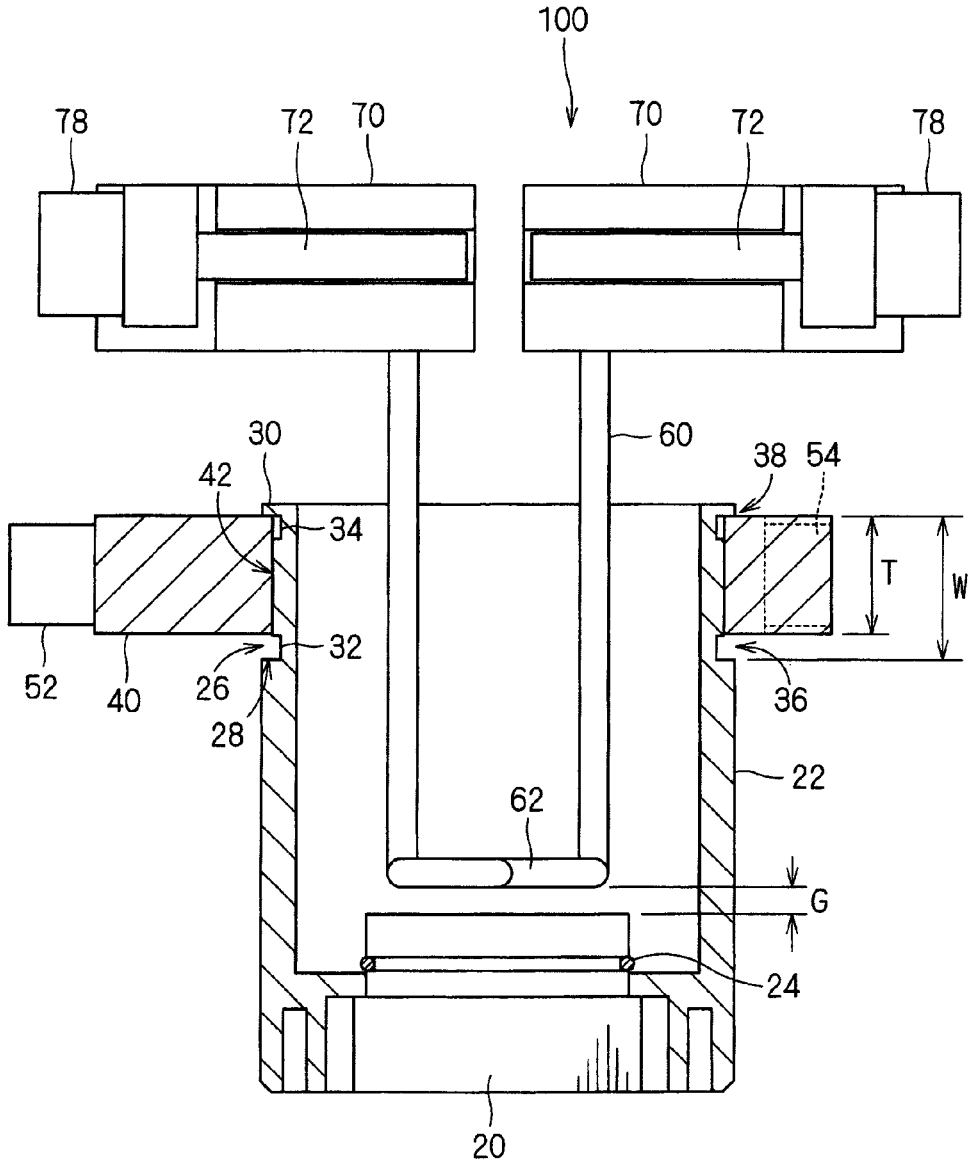
FIG. 7 is a view illustrating the method for assembling an indirectly-heated cathode assembly according to the invention.
Figure 8:
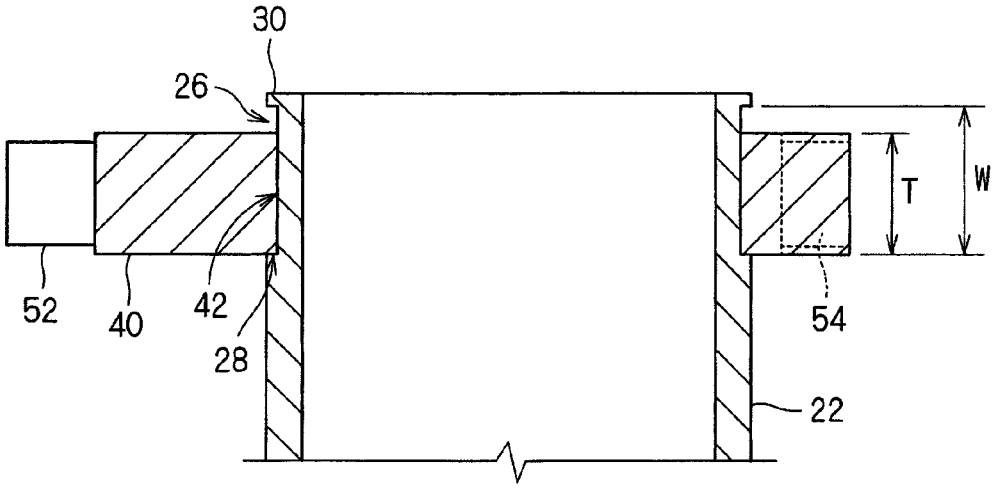
FIG. 8 is a section view showing another example of a groove of a cathode holder.
Figure 9:
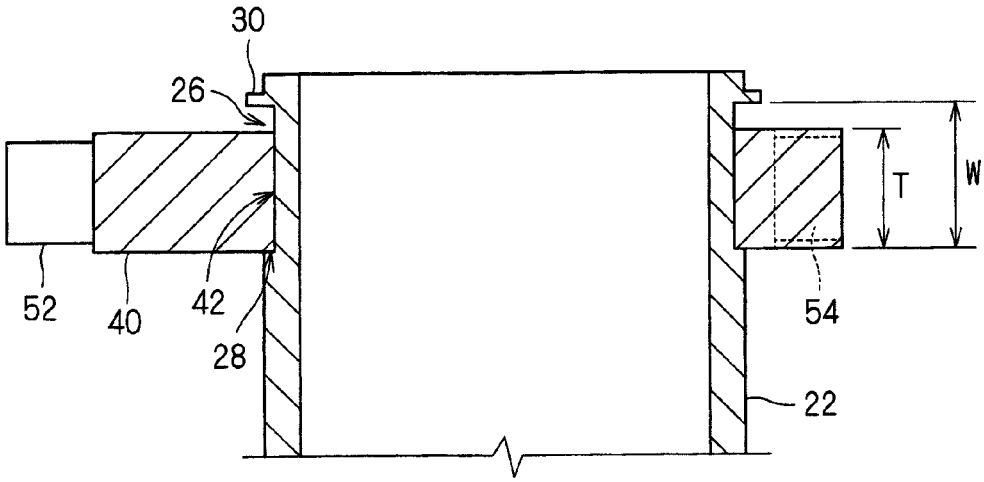
FIG. 9 is a section view partly showing another example of the cathode holder.

Referring also to FIGS. 5 to 7, a groove 26 and a projection 30 are disposed in an outer circumference of the cathode holder 22, more specifically, in the example, an outer circumference of a rear portion of the cathode holder 22. The projection 30 projects from a rear end of the groove 26 in a direction which substantially perpendicularly intersects an axis of the cathode holder 22 (i.e., in a radial direction). A range from the projection 30 to a front end face 28 which will be described later constitutes the groove 26. FIGS. 5 to 9 are views as seen in a direction of an arrow P in FIG. 1.

The position where the projection 30 is disposed is not restricted to the rear end of the cathode holder 22 as in the examples shown in FIGS. 1 and 5 to 8. As in an example shown in FIG. 9, for example, the position may be located slightly in front of the rear end of the cathode holder 22. In this case, also the position where the groove 26 is disposed is in a rear portion of the cathode holder 22, but slightly in front of the rear end of the cathode holder 22.

In the example, the projection 30 has an annular flange-like shape. According to the configuration, the projection 30 can be easily worked. Alternatively, the projection 30 may have a shape other than a flange-like shape, as described later.

As in the example shown in FIGS. 5 to 7, in the groove 26 of the cathode holder 22, deep portions 32, 34 which are deeper than the other portion may be disposed in the basal portions of the front end face 28 of the groove 26 and the projection 30. The situation where, in the working of the groove 26, inclined portions remain in corners of the basal portions of the front end face 28 and the projection 30 and the front end face 28 and the projection 30 are hardly caused to tightly butt against the cathode conductor 40 can be easily prevented from occurring. In the case where the working can be performed so that inclined portions do not remain, however, the deep portions 32, 34 may not be disposed as in the examples shown in FIGS. 8 and 9.

Figure 2:
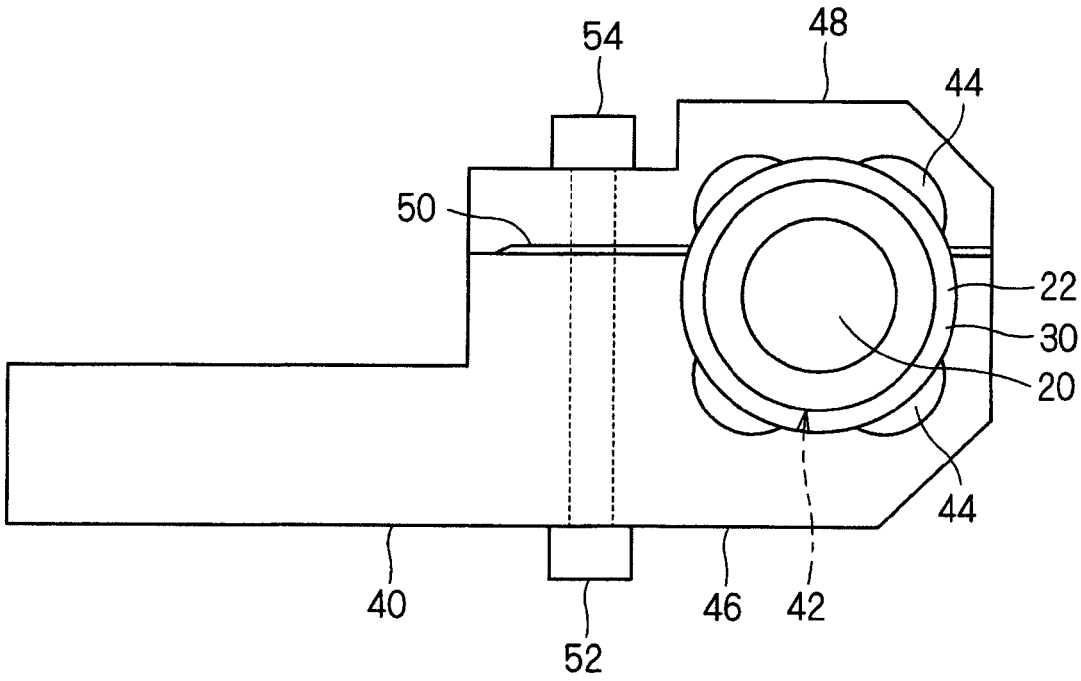
FIG. 2 is a plan view showing an example of a vicinity of a cathode conductor.

Referring also to FIG. 2, an opening 42 into which the portion of the groove 26 of the cathode holder 22 is fitted is disposed in the cathode conductor 40. A peripheral portion of the opening 42 is engaged with the projection 30 of the cathode holder 22. In other words, the opening 42 is a hole. A diameter of the opening 42 is larger than an outer diameter of the bottom face (the bottom face other than the deep portions 32, 34 shown in FIG. 5) of the groove 26 of the cathode holder 22, and smaller than an outer diameter of the projection 30.

In the example, as shown in FIG. 2, the cathode conductor 40 is configured by a first cathode conductor 46 and second cathode conductor 48 which are joined to each other through a joining portion 50, in order to enable the cathode holder 22 having the flange-like projection 30 to be fitted. The cathode conductors 46, 48 can be coupled to each other by using a bolt 52 which is passed through the cathode conductors 46, 48, and a nut 54. The cathode holder 22 can be fixed to the cathode conductors 46, 48, i.e., the cathode conductor 40. The bolt 52, and the nut 54, and the like constitute fixing means for fixing the cathode holder 22 to the cathode conductor 40.

Again referring also to FIGS. 5 to 7, in the groove 26 of the cathode holder 22, a width between the front end face 28 and the projection 30 is indicated by W, a thickness of the periphery (the vicinities of the portions engaged with the front end face 28 and the projection 30) of the opening 42 of the cathode conductor 40 is indicated by T, and a gap length which is between the filament 60 (specifically, the bent portion 62) and the cathode 20 (specifically, the rear face of the cathode), and which extends in a direction along the axis of the cathode holder 22 is indicated by G. The width W and the thickness T are determined so that the dimension W−T which is obtained by subtracting the thickness T from the width W is substantially equal to the gap length G which has a predetermined length (in other words, a target length). Namely, the groove 26 and the cathode conductor 40 are produced so as to attain such dimensions. The term "substantially" means that manufacturing errors usually exist in the components and hence dimension errors are allowed (the same shall apply hereinafter). When the gap length G of a predetermined length is 1.1 mm, for example, the width W is 6.1 mm and the thickness T is 5.0 mm.

Figure 3:
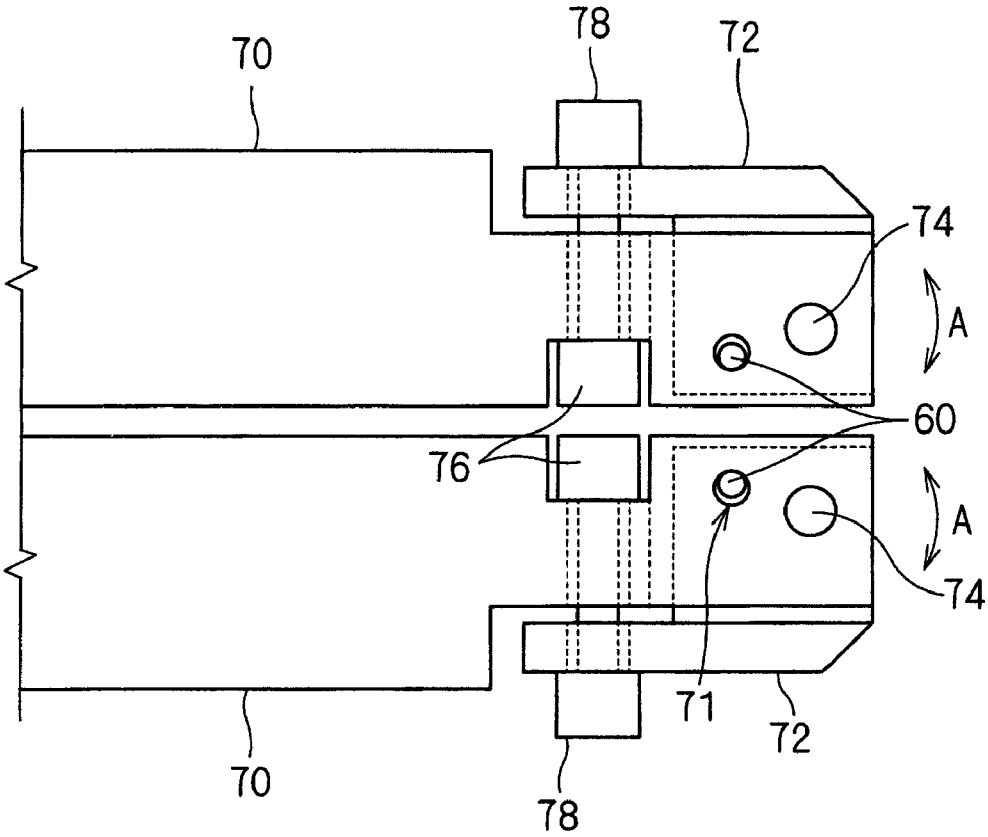
FIG. 3 is a plan view showing an example of a vicinity of filament conductors.

An example of fixing means for fixing the filament 60 to the filament conductors 70 will be described with reference also to FIG. 3. The two filament conductors 70 are juxtaposed while being close to each other. In a tip end portion of each of the filament conductors 70, a filament damper 72 is disposed so as to be swingable as indicated by the arrow A while setting a fulcrum member 74 as a fulcrum. The filament 60 (more specifically, the two leg portions 61) is passed through filament holes 71 of tip end portions of the filament conductors 70, and the filament damper 72 are fastened by bolts 76 and nuts 78, whereby the filament 60 can be fixed to the filament conductors 70.

In the example shown in FIG. 1, a cylindrical portion 64 which surrounds the leg portions 61 of the filament 60 is supported by the tip end portion of one of the filament conductors 70 through a supporting member 66. In FIGS. 5 to 7, in order to facilitate the understanding of the state of the filament 60, the illustration of the cylindrical portion 64 and the supporting member 66 is omitted.

An exemplary embodiment of a method for assembling the indirectly-heated cathode assembly 100 will be described with reference mainly to FIGS. 5 to 7. Usually, the indirectly-heated cathode assembly 100 is assembled in a state where it is separated from the plasma generating chamber 4 shown in FIG. 1.

As shown in FIG. 5, first, the portion of the groove 26 of the cathode holder 22 which supports the cathode 20 is fitted into the opening 42 of the cathode conductor 40 to attach the cathode holder 22 to the cathode conductor 40, the cathode holder 22 is rearward (upward in FIGS. 1 and 5 to 7, the same shall apply hereinafter) pushed to cause the front end face 28 of the groove 26 to butt against the cathode conductor 40, thereby eliminating a gap 36 between the two components 28, 40, and, in this state, the bolt 52 and the nut 54 are provisionally fastened to each other to provisionally fix the cathode holder 22, and then the cathode conductor 40 and at least one of the filament conductors 70 supporting the filament 60 are coupled and fixed to each other via an electrically insulating material 80 (see FIG. 1, the same shall apply hereinafter). Namely, the cathode conductor 40 and one of the filament conductors 70 are firmly fixed to each other. In the example, one of the filament conductors 70, and the cathode conductor 40 are coupled and fixed to each other via the electrically insulating material 80. In the coupling and fixing, bolts and nuts which are not shown are used. In this case, for example, the bolt 76 and the nut 78 for one of the filament conductors 70 may be provisionally fastened, and the filament 60 may be provisionally fixed in a state where it is adequately lifted up.

Next, the filament 60 is forward (downward in FIGS. 1 and 5 to 7, the same shall apply hereinafter) moved, and, as shown in FIG. 6, the filament 60 (more specifically, the bent portion 62) butts against the cathode 20 (more specifically, the rear face of the cathode 20), thereby eliminating the gap length G. In this state, the filament 60 is fixed to the two filament conductors 70, i.e., firmly fixed thereto. In the example, the filament clampers 72, the bolts 76, and the nuts 78 are used in the fixing.

Next, the bolt 52 and nut 54 which are provisionally fastened are loosened, and, as shown in FIG. 7, the cathode holder 22 is forward pulled to cause the projection 30 to butt against the cathode conductor 40, thereby eliminating the gap 38 between the projection 30 and the cathode conductor 40. In this state, the cathode holder 22 is fixed to the cathode conductor 40, i.e., firmly fixed thereto. In the example, the bolt 52 and the nut 54 are used in the fixing. In this way, the cathode holder 22 and the cathode 20 are pulled down by the dimension W−T.

When the state of FIG. 6 is changed to that of FIG. 7, the cathode holder 22 and the cathode 20 are pulled down by the dimension W−T, and hence the gap length G which has been once set to zero becomes substantially equal to the dimension W−T. Since, as described above, the dimension W−T is set to be substantially equal to the predetermined gap length G, the gap length G is made equal to the predetermined length without using a gap adjusting jig.

When the indirectly-heated cathode assembly 100 which is assembled as described above is located at a predetermined position with respect to the plasma generating chamber 4 as in the example shown in FIG. 1, whereby the ion source 2 can be configured.

According the assembling method, unlike the above-described related art, even when a gap adjusting jig is not used, the gap length G between the filament 60 and the cathode 20 can be adjusted to a predetermined length depending on the dimensions of the components themselves constituting the indirectly-heated cathode assembly 100, specifically, by using the dimension W−T which is the difference between the width W of the groove 26 of the cathode holder 22 and the thickness T of the cathode conductor 40.

Therefore, the above-discussed problems (a) to (d) of the related art can be solved. Namely, a gap adjusting jig is not necessary, the working accuracies are not affected by the working accuracy of the gap adjusting jig, and also the management of the gap adjusting jig is not necessary. Furthermore, the configuration where the projection 30 of the cathode holder 22 and the front end face 28 of the groove 26 butt against the cathode conductor 40 is used in the adjustment. Therefore, the cathode holder 32 is easily moved forward and rearward as described above, and hence the workability is excellent. Moreover, the reproducibility of the gap length G is higher as compared with the case where a gap adjusting jig is used.

The state of FIG. 5 may be configured in the following manner: (a) as in the exemplary embodiment, in the state where the cathode holder 22 is rearward pushed to eliminate the gap 36, the cathode conductor 40 and at least one of the filament conductors 70 are coupled and fixed to each other via the electrically insulating material 80; or (b) after the cathode conductor 40 and at least one of the filament conductors 70 are coupled and fixed to each other via the electrically insulating material 80, the cathode holder 22 is rearward pushed to cause the front end face 28 of the groove 26 to butt against the cathode conductor 40, thereby eliminating the gap 36. In the former configuration (a), before the coupling and fixing of the cathode conductor 40 and the filament conductors 70, the cathode holder 22 is pushed to eliminate the gap 36, and therefore fewer structures exist around the cathode holder 22, so that the workability is more excellent.

In the example shown in FIG. 2, four recesses (also they constitute one kind of opening) 44 are disposed so as to communicate with the opening 42 of the cathode conductor 40. According to the configuration, the heat transfer area between the cathode holder 22 and the cathode conductor 40 is reduced to reduce the heat loss, whereby the heating efficiency of the cathode 20 by the filament 60 can be improved.

As described above, the projection 30 of the cathode holder 22 is not always necessary to have a flange-like shape. In essence, any configuration where the projection 30 can be engaged with a peripheral portion of the opening 42 of the cathode conductor 40 can be employed. For example, the projection 30 may be configured by a plurality of projections. In a more specific example, the projection 30 may be configured by four projections which can be passed through the recesses 44, respectively. After the projections are passed through the recesses 44, the cathode holder 22 is swung by about 45 deg., so that the projection 30 can be engaged with a peripheral portion of the opening 42. In this case, the cathode conductor 40 is not always necessary to have the joined structure as in the example shown in FIG. 2.

The means for fixing the filament 60 to the filament conductors 70 is not restricted to the fixing means which has been described with reference to FIG. 3. For example, a structure where, in the same manner as the technique disclosed in FIG. 1 of Patent Reference 1, a slot (thin groove) is disposed in the vicinity of the tip end of each of the filament conductors 70, and the filament 60 is inserted into the slots to be fixed by the elasticity of the filament conductors 70 may be employed. Alternatively, a structure where the filament 60 which is passed through holes similar to the filament holes 71 shown in FIG. 3 is fixed by laterally fastening screws may be employed. In essence, any structure may be employed as far as the filament 60 can be fixed and unfixed.

The assembling method can be applied also to assembling of an indirectly-heated cathode assembly which is to be used in an application other than an ion source, such as a plasma generating apparatus in which a plasma is generated by using an indirectly-heated cathode assembly.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A method for assembling an indirectly-heated cathode assembly including: a tubular cathode holder which, assuming that a side from which thermal electrons are emitted is a front side, supports a cathode that emits thermal electrons, at the front side; a cathode conductor which supports said cathode holder; a filament which heats said cathode; and two filament conductors which support said filament, and which are juxtaposed with each other, the method comprising steps of:

disposing a groove and a projection in an outer circumference of said cathode holder, said projection projecting from a rear end of said groove in a direction which perpendicularly intersects an axis of said cathode holder, disposing an opening fitting a portion of said groove in said cathode conductor, a peripheral portion of said opening being engaged with said projection, determining, in said groove, a width (W) between said projection and a front end face of said groove and a thickness (T) of said cathode conductor in the periphery of said opening so that a dimension (W−T) which is obtained by subtracting the thickness (T) from the width (W) is substantially equal to a predetermined gap length (G) which is between said filament and said cathode, and which extends in a direction along the axis of said cathode holder, fitting the portion of said groove into said opening of said cathode conductor to attach said cathode holder to said cathode conductor, rearward pushing said cathode holder to cause the front end face of said groove to butt against said cathode conductor, coupling and fixing said cathode conductor and at least one of said two filament conductors to each other via an electrically insulating material, forward moving said filament to butt against said cathode, fixing said filament to said two filament conductors, forward pulling said cathode holder to cause said projection to butt against said cathode conductor, and fixing said cathode holder to said cathode conductor.

2. A method for assembling an indirectly-heated cathode assembly including: a tubular cathode holder which, assuming that a side from which thermal electrons are emitted is a front side, supports a cathode that emits thermal electrons, at the front side; a cathode conductor which supports said cathode holder; a filament which heats said cathode; and two filament conductors which support said filament, and which are juxtaposed with each other, the method comprising steps of:

disposing a groove and a projection in an outer circumference of said cathode holder, said projection projecting from a rear end of said groove in a direction which perpendicularly intersects an axis of said cathode holder, disposing an opening fitting a portion of said groove in said cathode conductor, a peripheral portion of said opening being engaged with said projection, determining, in said groove, a width (W) between said projection and a front end face of said groove and a thickness (T) of said cathode conductor in the periphery of said opening so that a dimension (W−T) which is obtained by subtracting the thickness (T) from the width (W) is substantially equal to a predetermined gap length (G) which is between said filament and said cathode, and which extends in a direction along the axis of said cathode holder, fitting the portion of said groove into said opening of said cathode conductor to attach said cathode holder to said cathode conductor, coupling and fixing said cathode conductor and at least one of said two filament conductors to each other via an electrically insulating material, rearward pushing said cathode holder to produce a state where the front end face of said groove butts against said cathode conductor, forward moving said filament to butt against said cathode, fixing said filament to said two filament conductors, forward pulling said cathode holder to cause said projection to butt against said cathode conductor, fixing said cathode holder to said cathode conductor.

* * * * *